US006662477B2

(12) United States Patent
Dowe et al.

(10) Patent No.: US 6,662,477 B2
(45) Date of Patent: Dec. 16, 2003

(54) SNOWBLOWER CONTROLS

(75) Inventors: James Thomas Dowe, Beaver Dam, WI (US); Rodney Allen Fritz, Nashotah, WI (US); Robert James Loehr, Kewaskum, WI (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/391,721

(22) Filed: Mar. 19, 2003

(65) Prior Publication Data

US 2003/0154632 A1 Aug. 21, 2003

Related U.S. Application Data

(62) Division of application No. 09/784,365, filed on Feb. 15, 2001, now Pat. No. 6,578,292.

(51) Int. Cl.[7] ..... E01H 5/09

(52) U.S. Cl. ..... 37/257

(58) Field of Search ..... 37/257, 242, 244, 37/247, 248, 249, 254, 259; 74/439; 192/3.54, 3.55, 3.62

(56) References Cited

U.S. PATENT DOCUMENTS

| | | | | | |
|---|---|---|---|---|---|
| RE19,754 | E | | 11/1935 | Johnson | |
| 2,315,007 | A | | 3/1943 | Morse et al. | |
| 2,536,166 | A | | 1/1951 | Garland | |
| 2,692,445 | A | | 10/1954 | Darnell | |
| D201,287 | S | | 6/1965 | Brennan | |
| 3,828,450 | A | | 8/1974 | Boeck | |
| 3,938,400 | A | | 2/1976 | Konyha | |
| 4,011,668 | A | | 3/1977 | Gunderson | |
| 4,062,135 | A | | 12/1977 | Dobberpuhl | |
| 4,230,200 | A | | 10/1980 | Carolan | |
| 4,255,879 | A | | 3/1981 | Greider | |
| 4,362,228 | A | * | 12/1982 | Plamper et al. | 477/170 |
| 4,402,149 | A | | 9/1983 | Fujii | |
| 4,428,180 | A | * | 1/1984 | Carlson | 56/11.3 |
| 4,430,848 | A | * | 2/1984 | Wistrom | 56/11.3 |
| 4,457,086 | A | | 7/1984 | Bacon | |
| 4,476,643 | A | | 10/1984 | Hilchey et al. | |
| 4,756,101 | A | | 7/1988 | Friberg et al. | |
| 4,869,124 | A | * | 9/1989 | Czeban et al. | 74/526 |
| 4,915,203 | A | * | 4/1990 | Schweitz et al. | 192/48.5 |
| 4,984,479 | A | | 1/1991 | Phillips | |
| 5,000,302 | A | | 3/1991 | Takeshita | |
| 5,018,592 | A | | 5/1991 | Buchdrucker | |

(List continued on next page.)

OTHER PUBLICATIONS

John Deere, "Snow Removal Equipment", of pp. 1–8, see all, date of publication Jul. 1999, published in U.S.A.

Yamaha, "Snow Blowers", of pp. 1–8, see all, date of publication 1989, published in U.S.A.

Honda, "Schneefrasen", of pp. 1–4, see all date of publication unknown, published in Europe.

*Primary Examiner*—Victor Batson

(57) ABSTRACT

A control platform for directing the operation of a snowblower is provided. The platform includes a bail which is pivotably moveable within the platform. Attached to and moveable with the bail are levers for controlling the engagement or disengagement of the drives that power the snowblower's wheels and auger. Also attached with the bail are controls which permit the operator to change the speed and/or direction of the snowblower as well as the orientation of the discharge chute. Through their attachment to the bail and proximity relative to one another, an operator can use each of the levers and controls simultaneously. Accordingly, the platform permits an operator to engage or disengage the drives which power the snowblower's wheels and auger while, simultaneously, enabling a change in speed or direction as well as the direction towards which snow is directed during the removal process.

5 Claims, 7 Drawing Sheets

U.S. PATENT DOCUMENTS 5,020,250 A 6/1991 Fujii et al.
5,123,186 A 6/1992 Matushita et al.
5,261,141 A * 11/1993 La Boda ..... 15/52.1
5,438,770 A 8/1995 Miller
6,131,316 A 10/2000 Yoshina et al.
6,470,602 B2 * 10/2002 White et al. ..... 37/244
6,499,236 B2 * 12/2002 Yoshida et al. ..... 37/219
6,550,161 B2 * 4/2003 Hanafusa et al. ..... 37/246
6,578,292 B2 * 6/2003 Dowe et al. ..... 37/257

* cited by examiner

SNOWBLOWER CONTROLS

CROSS REFERENCE

This application is a division of U.S. application Ser. No. 09/784,365, filed Feb. 15, 2001 now U.S. Pat. No. 6,578,292 B2, Jun. 17, 2003.

BACKGROUND OF THE INVENTION

1. Field of the Invention

This invention relates to snowblowers and more specifically to a control structure for engaging the drives to the wheels and the discharge auger and for swingably moving the discharge chute.

2. Description of Related Art

Snow removal equipment such as walk-behind snowblowers include a frame or chassis to which is mounted a pair of ground engaging drive wheels, an engine, and an auger in the form of a rotary blade for slicing and shifting snow toward a discharge chute where it is then expelled. To assist the operator in directing movement of the snowblower, there ordinarily exists a pair of curved handles which extend upwardly from the chassis. The ends of these handles have grips for the operator to hold and guide the machine as it is operated. Often, the handle and grip portion are bent straight out towards the operator. Typically, both drive wheels are driven together and are not independently powered. Accordingly, snowblowers are turned through pushing on one handlebar and holding or pulling on the other. With handles which extend at the operator, it can be difficult for the operator to exert the necessary forces required to turn the machine. This is particularly true for large machines and/or smaller operators. Thus, it would be beneficial to provide a handle that has a configuration and design which would decrease the amount of leverage needed to maneuver the snowblower.

It is common to provide snowblower controls that engage the traction drive and auger, adjust the speed and direction of the machine and orient the discharge chute at a control panel. The panel is usually secured to the handlebar(s) forwardly of the grips. Typical control levers used to engage the traction drive and/or auger are mounted to the handlebar and have an underside conforming to the shape of the handlebar. These levers pivot on the handlebar and extend upwardly from the bar when their respective auger or traction function is not engaged. To engage the auger or traction drive, an operator must press the respective lever downwardly against the handlebar and hold it there as long as engagement is desired. If the operator releases the lever, its auger or traction function will disengage.

Many times, control levers and handles for changing the speed and direction of the snowblower drive wheels, as well as the orientation of the chute through which snow is directed, are also located on the control panel. These levers and handles are placed throughout a top surface of the panel and spaced at a distance from the auger and traction controls which are used to engage the drives to the wheels and the auger. To adjust the speed or direction of the snowblower or to adjust the orientation of the chute, the operator must take one hand off the control and move it to the corresponding control for machine speed or orientation of the chute. In doing so, the drives to the wheels and/or the auger will no longer be engaged since the control levers for those drives will no longer be pressed against the handlebar. In other words, as a result of the spacing between the auger and traction levers and above-mentioned controls, an operator is unable to maintain engagement of both the snowblower's traction drive and auger while making another adjustment such as, for example, shifting into a different operating speed.

Thus, it would be desirable to provide a configuration of controls which would allow the operator to use the snowblower with both the traction drive and auger engaged, while at the same time, allowing the ability to shift into a different speed or direction and/or change the orientation of the chute through which snow is expelled.

SUMMARY OF THE INVENTION

To address the above desire, there is provided a control platform which permits continued engagement of the traction drive and auger while allowing an operator to simultaneously adjust the machine speed and/or direction as well as the orientation of the snow discharge chute. Adjustment of the machine speed and/or direction can be made with the thumb of one hand while the orientation of the chute can be adjusted with the thumb of the other hand.

The control platform is mounted atop a handlebar framework which extends upwardly from the snowblower chassis. The platform has attached to it a bail which is pivotably moveable fore and aft within the platform. Attached to the bail is a pair of control levers, one for engaging or disengaging the traction drive and another for likewise controlling engagement and disengagement of the auger. The control for varying the speed and direction of the drive wheels, once engaged, is provided through swingably mounting the bail for fore and aft motion. To lock the speed in any of a variety of settings, there is provided a releasable pawl carried by the bail for engagement with slots in the platform to secure the bail in any of a plurality of positions as the speed or direction of the snowblower is changed. Selection of either a different speed or direction occurs when the operator engages the pawl with a particular slotted portion of the platform.

The bail with its levers and pawl are swingably coupled so as to allow the operator to control engagement of the traction drive and auger while, at the same time, allowing a change in the speed or direction of the snowblower.

Also attached to the bail is a toggle switch that controls an electrical motor which changes the orientation of the snow discharge chute and thus, the direction towards which snow is expelled from the snowblower. The toggle switch is attached to the bail and is located beside the control lever for the auger. Because of the switch location, operation of the auger and chute may occur without requiring the operator to remove his or her hand from the auger control lever since the switch is controllable by the push of a thumb. Accordingly, operation of the auger as well as manipulation of the directional movement of the discharge chute may take place simultaneously. Vertical deflection of the snow as it is discharged from the chute is achieved through use of a cap mounted on top of the chute which is controlled by a handle carried on the handlebar framework to the side of and in front of the switch.

Thus, there is provided a configuration of controls for allowing an operator to obtain simultaneous activation of the drives for the wheels and the auger while, at the same time, enabling concurrent adjustments of other controls of the snowblower's operation. Additionally, the configuration provides a bail with ends having a downward slope in order to allow an operator to more easily grasp and control those ends by being able to exert greater leverage over them when operating the snowblower. Accordingly, the operator is able to minimize the pushing or pulling often required by previous designs, thus resulting in easier and less stressful operation of the snowblower.

DESCRIPTION OF THE PREFERRED EMBODIMENT

Figure 1:
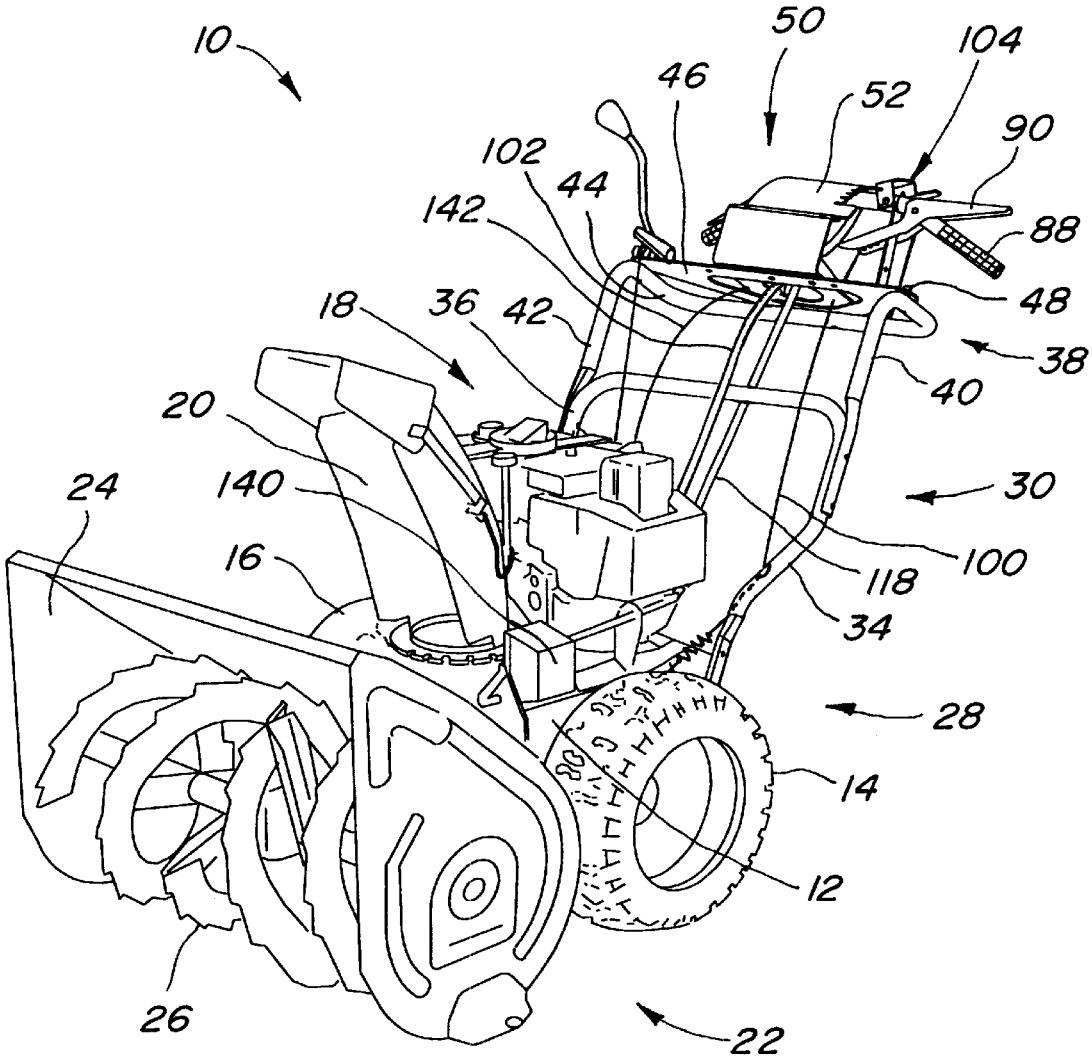
FIG. 1 is a front and side elevation view of the snowblower according to the present invention.
Figure 2:
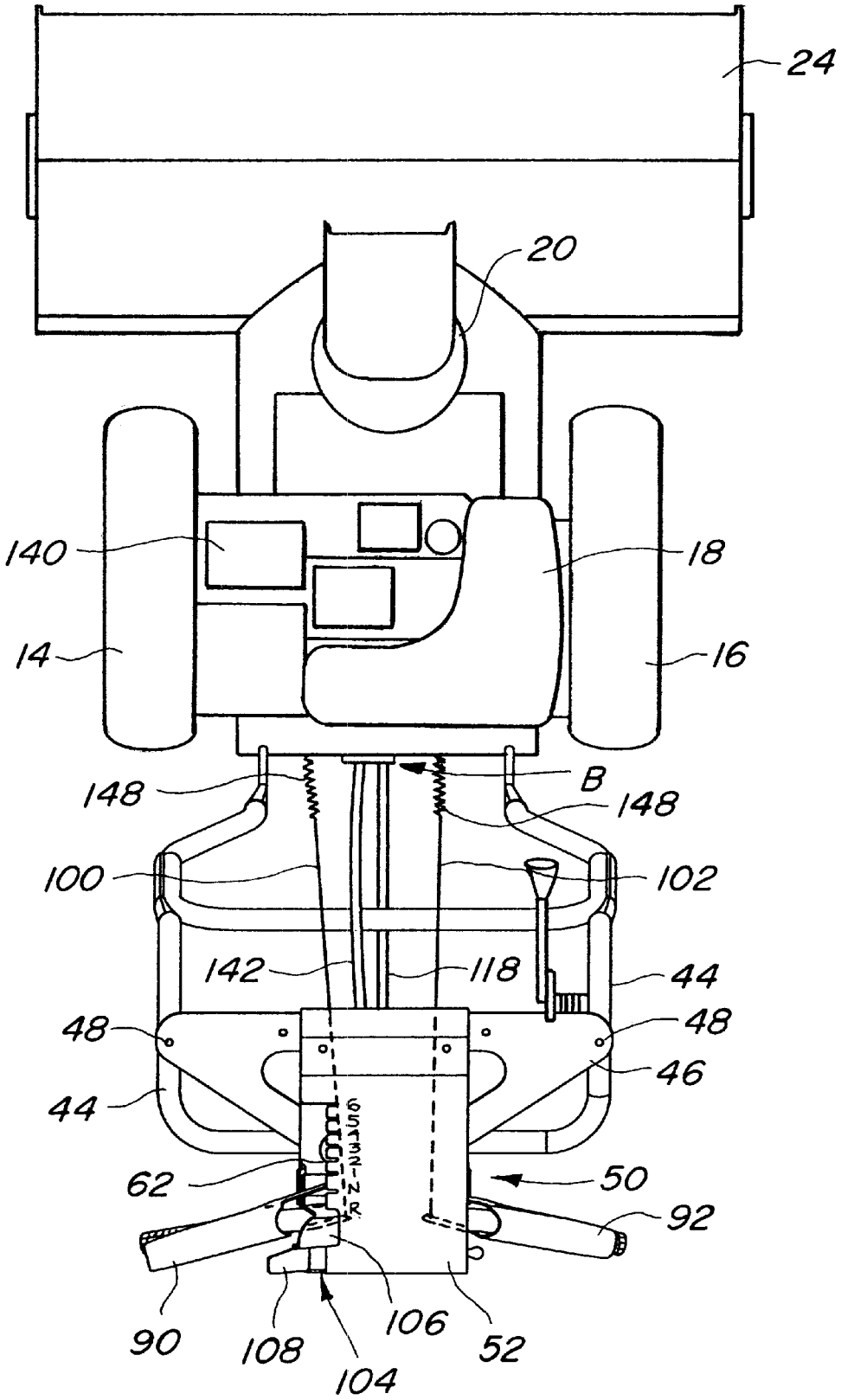
FIG. 2 is a plan view of the snowblower as illustrated in FIG. 1.

As illustrated in FIG. 1, there is shown a snowblower 10 having a frame 12 supported upon a pair of ground engaging drive wheels 14, 16 and including an engine 18 and discharge chute 20 mounted with the frame 12. At the front 22 of the snowblower 10, there is provided a collector housing 24 which surrounds an auger 26. The auger 26 is provided as a helical/spiral shape rotary blade which slices through and then shifts snow towards an opening (not shown) in the frame 12. The opening serves as a passageway through which snow is directed to the discharge chute 20. Upon entering the chute 20, snow is directed outwardly and away from the snowblower 10. At the rear 28 of the snowblower 10 is a mounting or handlebar arrangement 30 extending upwardly and away from the frame 12. Arrangement 30 is a U-shaped extension having legs 34, 36 and is connected with the rear portion 28 of the frame 12. Bolted to legs 34, 36 is a further U-shaped handlebar arrangement 38 having a set of members 40, 42 which curve to form a rearwardly bent portion 44.

As shown throughout FIGS. 1–8, a mounting plate 46 is attached to the portion 44. Plate 46 is joined to portion 44 through the use of fasteners 48 such as bolts and nuts. A control platform or unit 50 for directing various functions of the snowblower's operation is attached to the plate 46. Those functions include engaging or disengaging the drives for the wheels 14, 16 as well as the auger 26, changing the speed or direction of the machine, and providing a different orientation for the discharge chute 20. The platform 50 is open at its sides and is constructed of sheet metal having a generally rectangular configuration with top and bottom surfaces 52 and 54, respectively, and front and rear faces 56 and 58. Each of the surfaces 52, 54 and faces 56, 58 provide a housing for the structure discussed below and contained therein. In the preferred embodiment, platform 50 will be covered by a casing (not shown) provided to shelter platform 50. The top 52 of the platform 50 is an arcuately shaped surface having a downward slope beginning at the rear 60 of the platform 50 and accelerating as the top surface 52 extends towards the front 22 of the snowblower 10. Along this downwardly sloped top surface 52 are notches 62 permitting a selection of speeds and directions in which the snowblower 10 may travel.

Figure 6:
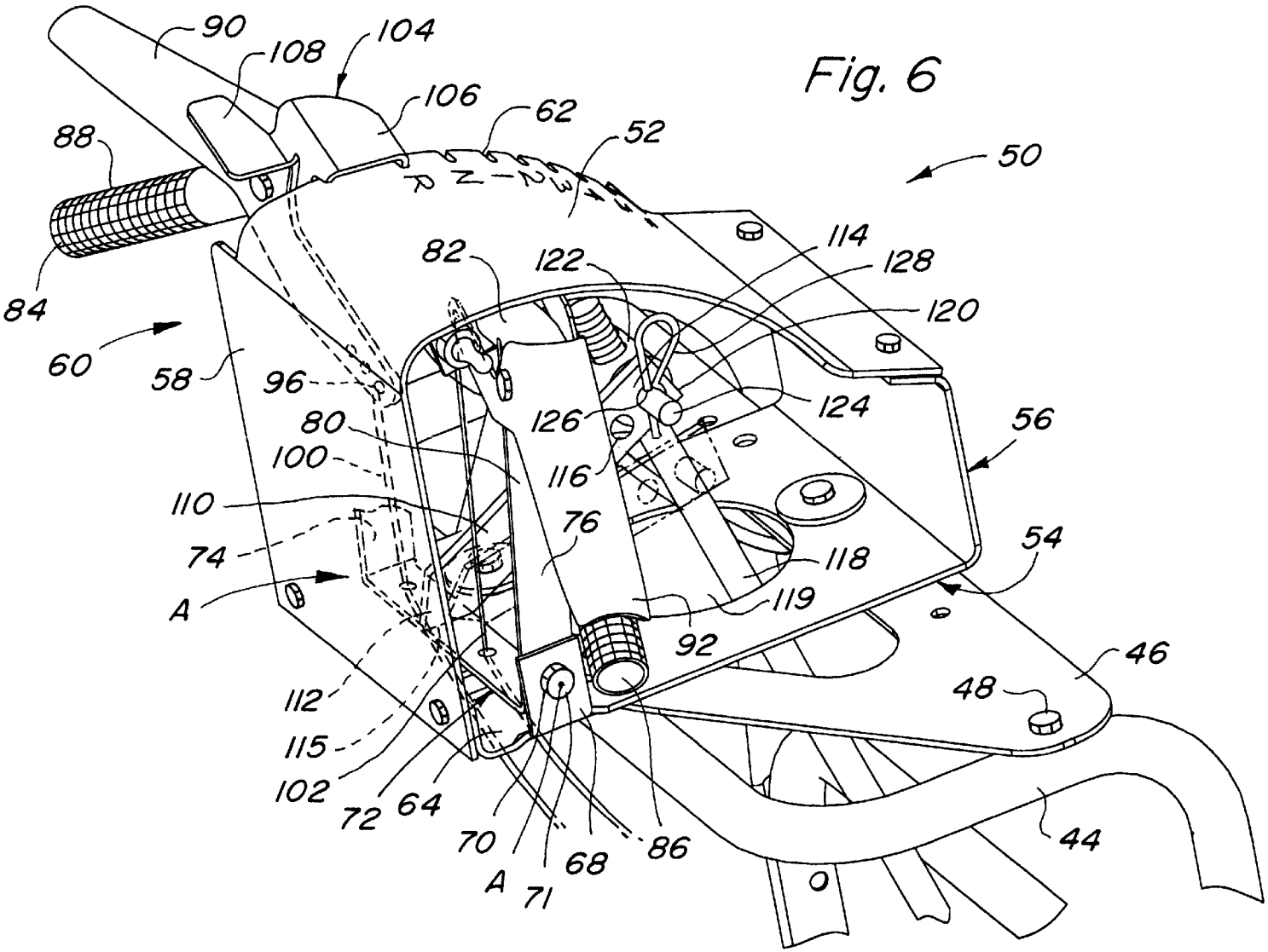
FIG. 6 is a rear and side elevated perspective view of the right side of the control platform.
Figure 7:
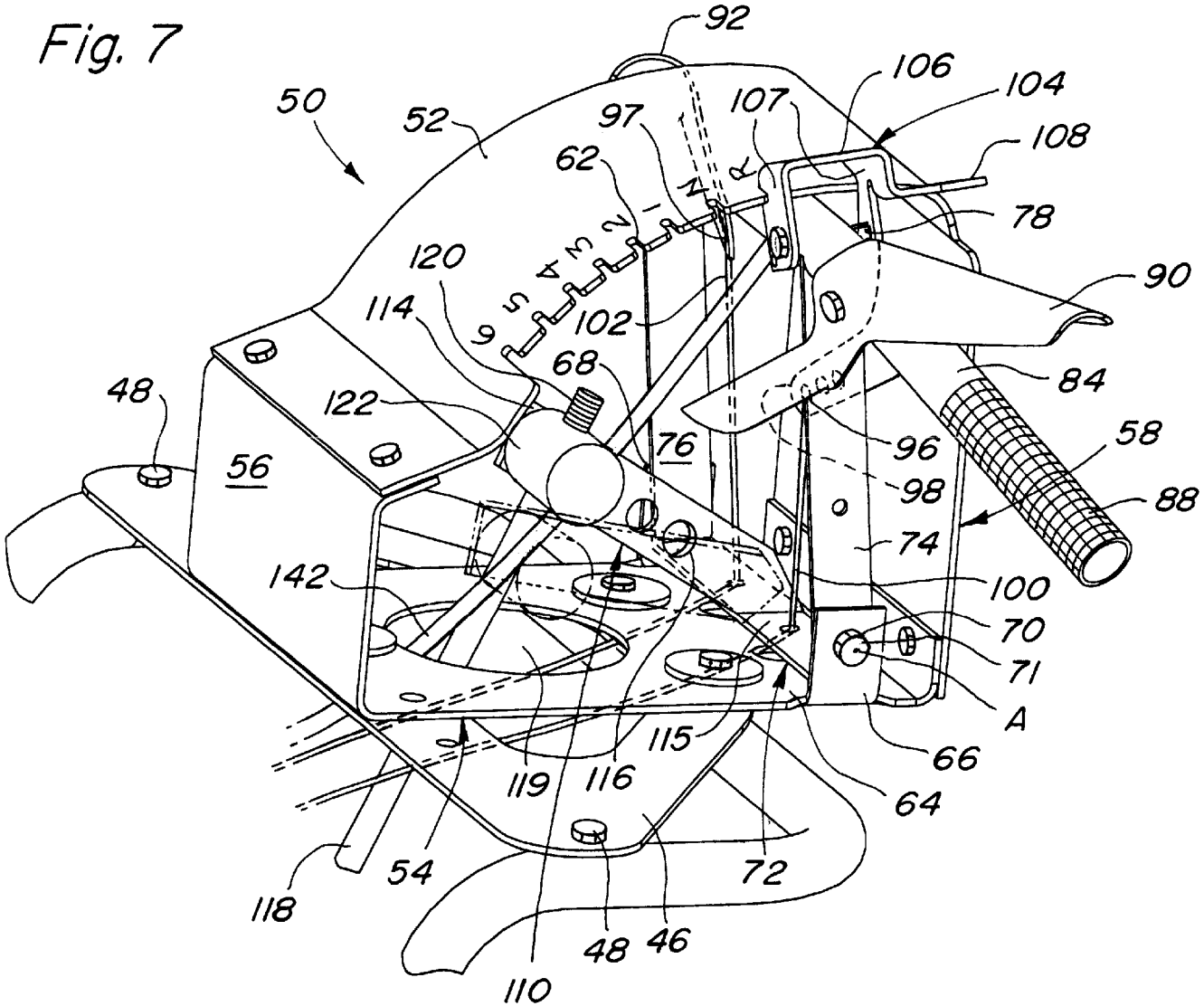
FIG. 7 is a front and side elevated perspective view of the left side of the control platform.
Figure 8:
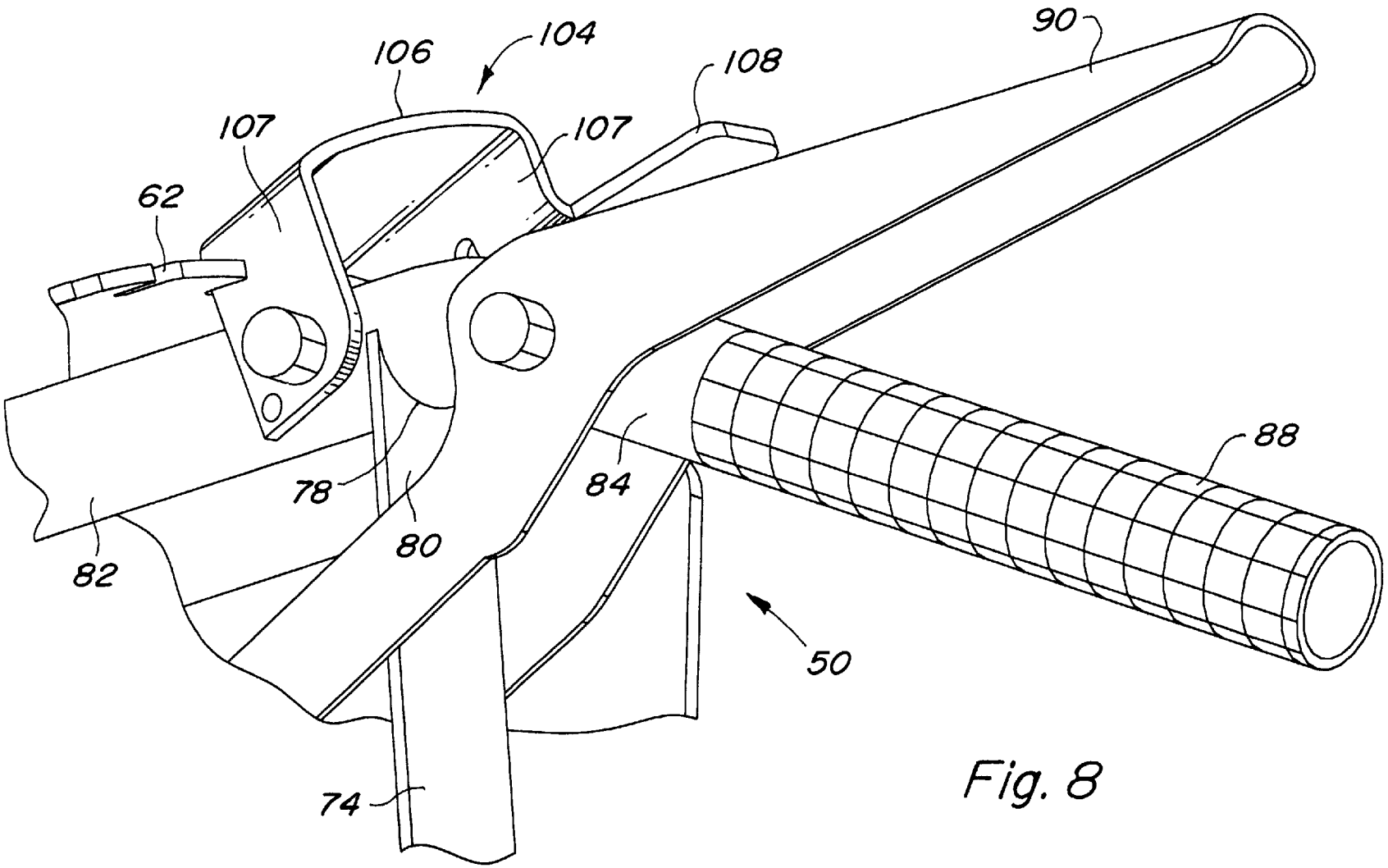
FIG. 8 is an enlarged side elevated perspective view illustrating the drive control lever and pawl mounting on the handlebar.

Looking specifically to FIGS. 6 and 7, the rear bottom surface 64 of platform 50 includes two upturned mounting tabs 66, 68, one on either side of the bottom surface 64. Mounts 66, 68 align with each other and contain an opening 70 therethrough. Pins 71 are carried in the openings 70 and pivotally connect a U-shaped bracket 72 at point A shown in FIG. 7 to each of the mounts 66, 68. Bracket 72 has a pair of upwardly extending legs 74, 76. As seen in FIG. 8, leg 74 and also unshown leg 76 include arcuately shaped depressions 78 at their ends 80 to which is secured a bail 82. Bail 82, which is partially housed within platform 50, is thereby allowed to pivot fore and aft about the pins 71 mounted at point A to control fore and aft movement of the snowblower 10.

Figure 4:
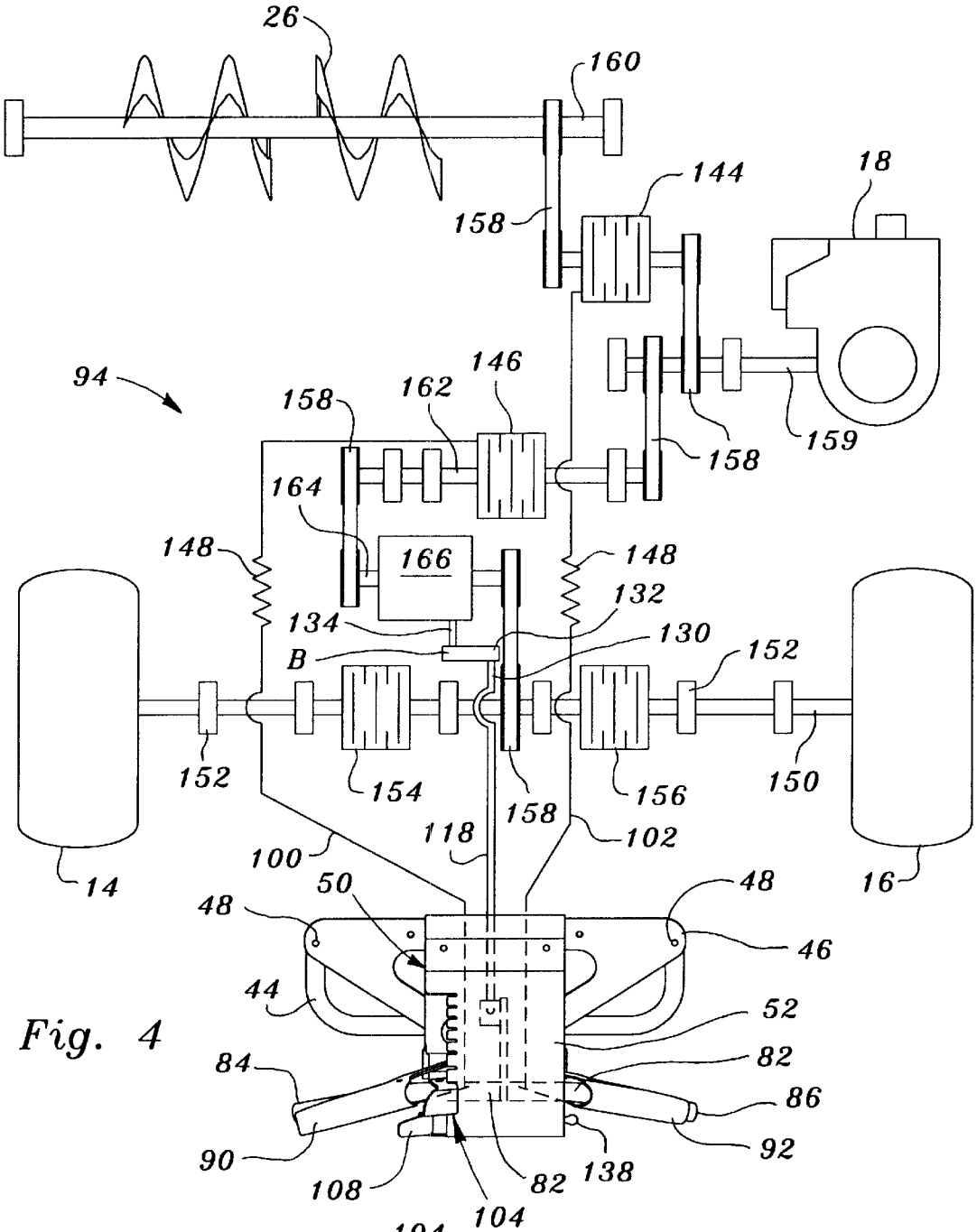
FIG. 4 is a schematic illustrating the snowblower drive, auger and control components.
Figure 5:
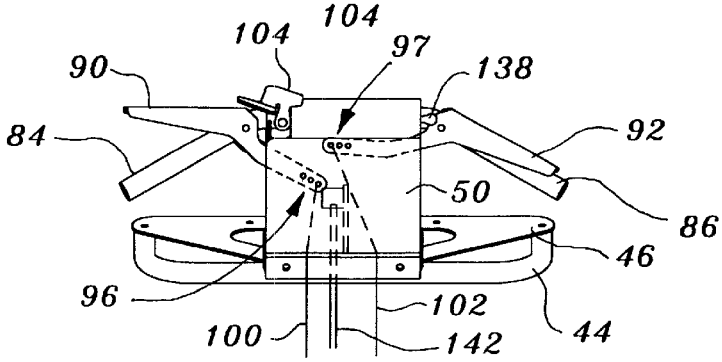
FIG. 5 is a rear elevated perspective view of the control platform according to FIG. 4.

As shown in FIGS. 4 and 5, bail 82 has left and right ends 84, 86 which extend from the middle thereof and protrude from the platform 50 for permitting an operator to grasp the bail 82 and operate the snowblower 10. To make that grasp easier, rubber grips 88 are provided to cover each of the ends 84, 86. Additionally, each grip 88 may have heating elements therein (not shown) for warming an operator's hands when using the snowblower 10.

As best seen in FIGS. 6–7, left and right control levers 90, 92 are pivotally fastened with the bail 82. Lever 90 is attached to the left end 84 of the bail 82 and is used to engage or disengage a drive system 94 providing power or traction to wheels 14, 16; and thus allows the snowblower 10 to obtain and maintain either forward or rearward motion. Lever 92 is connected with the right end 86 of bail 82 and controls engagement or disengagement of the auger 26. Each of the levers 90, 92 has holes 96 and 97 at their respective ends 98. Holes 96, 97 allow for attachment of cables 100, 102, as best seen in FIG. 7, with the respective lever 100 or 102 at one end thereof. At the other end of the cables 100, 102, connection is made with respective drive wheel and clutching structures that are controlled by the respective levers 90, 92.

Figure 3:
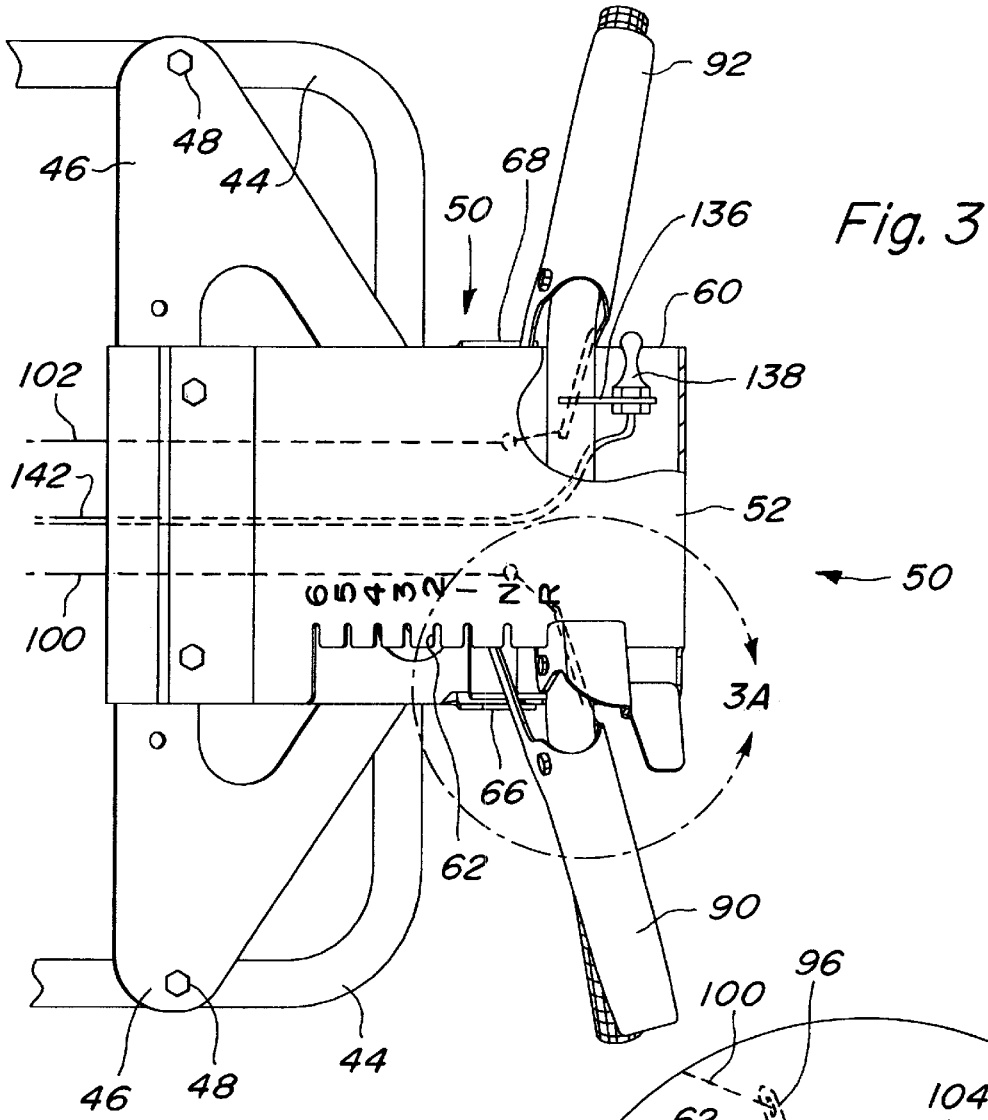
FIG. 3 is an enlarged plan view of the control platform included in the present, invention.
Figure 3A:
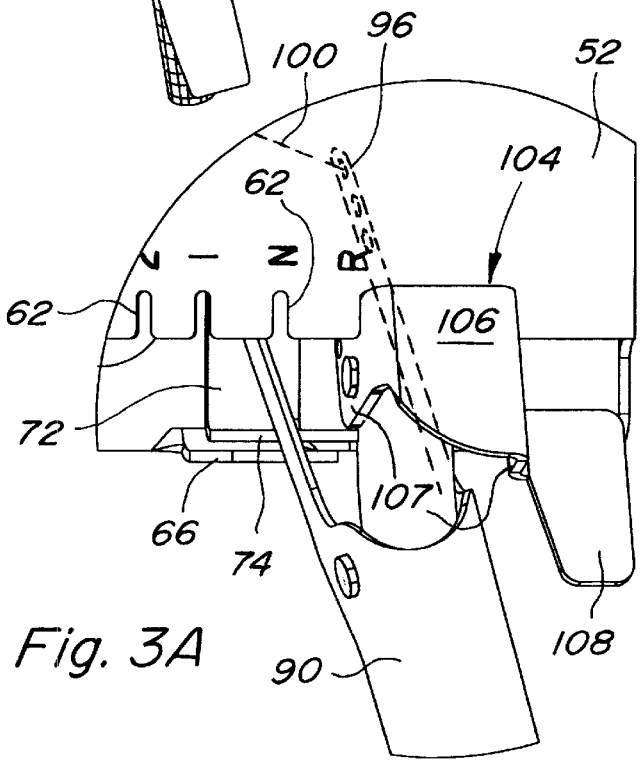
FIG. 3A is an enlarged view of the traction control lever and a thumb operated pawl.

To select a particular speed and direction for the drive wheels, a pawl 104 is pivotally attached to the swinging bail 82 at a mid-portion thereof, as best shown in FIG. 3A. Pawl 104 has a top surface 106 connecting arms 107 and a thumb tab 108. The tab 108 can easily be actuated by an operator's thumb when his/her hand is on the lever 90 and while the snowblower 10 is operating. With this structure, the operator can engage or disengage the drive system 94 to engage the wheels 14, 16 by squeezing the clutching lever 90 as well as select the speed and direction of the drive wheels 14, 16 through engaging the pawl 104 in one of its plurality of settings.

To actuate the transmission and change the speed or direction of the drive wheels 14, 16 as the bail 82 is swung fore and aft about its pivot A, there is provided a forwardly extending post 110 secured to the base of the U-shaped bracket 72, see FIGS. 6 and 7. The post 110 includes first and second ends 112, 114 with end 112 being fixedly joined to the bracket 72 at a midpoint 115 thereof. The post 110 is connected to bracket 72 at an angle to permit it to swing fore and aft and to avoid interference with platform 50 as the bail 82 moves. At the opposite end 114 of post 110, there is provided a series of holes 116 that allow a peg 124 of collar 122 to be attached to the post in one of the holes 116, see FIGS. 6 and 7. The collar 122 is adapted to threadably receive a linkage rod 118, at a first end 120 thereof, which in turn is coupled with structure, discussed below, to selectively change the speed or direction of the transmission. Thus, with the connection of the swingable bail 82 to post 110 and rod 118, bail 82 is linked to the drive system 94, thereby allowing an operator to swing the bail 82 and change the speed or direction of the snowblower 10 while operating.

Collar 122 includes the peg 124 for mating engagement with the post 110 via insertion through one of the holes 116. Peg 124 contains an opening 126 through which a fastener, preferably a spring locking pin 128 is placed, as shown in FIG. 6. Pin 128 is placed through opening 126 so as to secure the collar 122 to the post 110 and couple the rod 118 with the post 110. Looking now to FIG. 4, it can be seen that at a second end 130 of rod 118, an oblong plate 132 extends transversely to the longitudinal axis of the rod 118. The plate 132 is interconnected with a rotating link or pin 134 to the drive system 94 at point B for permitting movement of the snowblower 10 upon actuation of the bail 82 in a forward or rearward direction.

Looking now to the auger orientation control and FIG. 3, it can be seen that a bracket 136 is secured perpendicularly to the handlebar 82. The bracket 136 carries or supports an electrical switch 138 which is connected to and controls power supplied to a motor 140, as shown in FIG. 1. The motor 140 is supported on top of the frame 12 adjacent the discharge chute 20 and coupled with the chute in a conventional way to swing the chute about a vertical axis to direct the discharge of snow in any of a variety of directions. In the preferred embodiment, switch 138 is provided in the form of a toggle permitting the operator to use only a thumb when desiring to control operation of the chute 20. This form permits the operator's right hand to be kept on the bail 82 to maintain engagement of the drive system or auger 26 while at the same time allowing orientation of the discharge chute 20 to be controlled. Wires electrically connecting the switch 138 to the motor 140 are housed within a span of tubing 142, as shown in FIG. 1.

With FIG. 4, a schematic is provided showing connection of the control platform 50 beyond the mounting plate 46. Connected with the first and second levers 90, 92, respectively, are the cables 100,102. Each cable 100, 102 attaches the lever 90 or 92 to the respective structure which it controls. Cable 100 connects the first or left lever 90 with a first clutch 146 which is used to deliver power to the wheels 14, 16 to allow the snowblower to move forwardly or rearwardly at a chosen speed. Similarly, cable 102, as shown in FIG. 4, connects the second or right lever 92 with a second clutch 144 used to transfer power from the engine 18 to the auger 26. Each of the cables 100, 102 includes a spring 148 to provide proper tensioning along the length thereof to reduce the likelihood of their lengthening or breakage.

Each of the drive wheels 14, 16 is mounted along a driven shaft or axle 150. Also mounted on the shaft 150 are a series of structural supports 152. Further mounted with the shaft 150 is a pair of clutches 154, 156. Each of the clutches 154, 156 is operable upon load to transfer power and control the direction of each of the wheels 14, 16 after clutch 146 has been actuated. Power is transferred from the engine 18 to both of the wheels 14, 16 and the auger 26 via a system of pulleys and belts, designated generally as 158, which are connected with an output shaft 159 and further shafts 160, 162, 164 to which the wheels 14 and 16 and auger 26 are attached. Allowing changes in power and direction of each of the wheels 14 and 16 is a transmission 166 which is similarly connected to the shaft 150 by a pulley and belt arrangement 158. Transmission 166 is provided, preferably, in the form of a friction disc drive. However, the control platform 50 is also contemplated to function with a hydrostatic transmission as well.

In use, the control platform 50 permits the operator to perform any combination of four functions simultaneously whereby those functions include: (1) engaging or disengaging the drive system 94 to deliver or not deliver power to the wheels 14, 16; (2) adjusting the speed or direction of the snowblower 10 while in operation; (3) engaging or disengaging the auger 26; and (4) adjusting the orientation of the snow discharge chute 20. Allowing these functions to be performed together is the ability to move the bail 82 within the platform as well as the proximity of the pawl 106 and toggle switch 138 relative to the bail 82.

First, to provide traction or motion to the snowblower's drive wheels 14, 16, an operator squeezes left lever 90 shown in FIG. 7 downwardly against grip 88 at end 84 of the bail 82. When the lever 90 is squeezed, the cable 100 interconnecting the lever 90 and clutch 144, as shown in FIG. 4, engages clutch 144 so as to allow power to be transferred between the engine and the respective wheel clutches 152, 154 and then to each of the wheels 14, 16. If the lever 90 is not squeezed or otherwise pressed against the grip 88, no power is transferred to the wheels 14, 16, thus leaving the snowblower 10 in a stationary position.

Second and similarly as shown in FIGS. 6 and 4, an operator may hold right lever 92 downwardly against grip 88 and end 86 of bail 82 so as to engage the clutch 146 and allow power to be driven from the engine 18 to the auger 26. When this occurs, auger 26 will begin to turn, thereby allowing snow removal to occur. In a disengaged or inactive position, clutches 144 and 146 are spring loaded, causing each of the levers 90, 92 to be biased upwardly and away from the bail 82.

Looking to FIG. 7, while the lever 90 is held against grip 88 of bail 82, an operator may change either the speed or direction of the snowblower 10. An operator may change the speed or direction by moving the bail 82 and attached pawl 104 forwardly or rearwardly. To accomplish this, the pawl 104 which is pivotally attached with the bail 82 at a mid-portion thereof and to the right of lever 90, allows the operator to use his/her left thumb to engage or disengage the pawl 104 and notch 62 of platform 50 and change the positioning of bail 82. Pawl 104 is biased for movement in and out of a particular notch 62 by a spring (not shown) connected to the pawl 104 and pin 71 therebelow. While the bail 82 is in a stationary position, the pawl 104 rests against a portion of platform 50 and within the notches 62 provided along the left side thereof. When the bail 82 is moved, pawl 104 moves with bail 82 to pivot about point A. As this occurs, an operator may choose to lock the pawl 104 into any one of the notches 62. Notches 62 represent a selection of reverse and neutral positions as well as positions representing six levels of speed. Further, as the operator actuates or moves the pawl 104 into a different notch 62, the change in speed or direction with respect to drive 94 is accomplished via connection of post 110 and rod 118 with the transmission 166. As shown in FIG. 7, post 110 is, preferably, welded to the bottom of bracket 72 and angularly forward of the legs 74, 76. Post 110, and thus bail 82, is connected to transmission by the rod 118. As bail 82 is moved forwardly or rearwardly and pawl 104 is positioned within one of the various notches, movement of the post 110 and rod 118 together, as seen in FIGS. 6 and 7, effects a change in the drive 94 thereby allowing the operator to control the snowblower 10 at a different speed or in a different direction.

Additionally, switch 138, as best shown in FIG. 3, is located to the left of right lever 92 so as to allow the operator to control the orientation of the snow discharge chute 20 and thus, the direction towards which snow is thrown during the removal process. To effect a different orientation, the operator need only apply sustained pressure to the switch 138. Doing so will activate the motor 140 which is geared to and positioned adjacent the chute 20, as shown in FIG. 1, to cause the chute 20 to move to a different location.

All of the above functions may be accomplished simultaneously due to the proximity and cooperation of their respective controlling structure. Thus, the operator is permitted to retain his/her hands on both the traction and auger controls 90, 92 while still being able to control selection of speed and/or direction as well as the orientation of the discharge chute 20. Accordingly, the ability to control all of these functions simultaneously enables the operator to experience greater comfort and flexibility in operation of the snowblower since his/her hands may remain on the bail at all times.

While the present invention has been described in conjunction with a specific embodiment, it is understood that many alternatives, modifications, and variations will be apparent to those skilled in the art in light of the foregoing description. Accordingly, this invention is intended to embrace all such alternatives, modifications and variations which fall within the spirit and scope of the appended claims.

What is claimed is:

1. A control structure for use with a snowblower having a frame, a power source, a pair of drive wheels, a snow discharge auger, a transmission carried by the frame and which is drivingly coupled to the wheels to drive the wheels in forwardly and rearwardly directions and at one of a plurality of speeds, a handlebar frame extending upwardly and rearwardly from the frame, a first clutch means between the power source and the transmission for drivingly engaging the transmission, and a second clutch means between the power source and the auger to drivingly engage or disengage the auger, the control structure comprising:

a) an elongated bail having first and second end portions and which is swingably mounted with the handlebar frame for fore and aft movement about a generally laterally extending axis;

b) linkage means coupling the bail and transmission and which is operable to actuate the transmission and shift it so that it drives the wheels in the forwardly or rearwardly direction at any of a plurality of speeds;

c) a first control lever carried on one end portion and which is operable to drivingly engage or disengage the first clutch means; and, d) a second control lever carried on the other end portion and which is operable to drivingly engage or disengage the second clutch means.

2. The control structure as recited in claim 1, further comprising:

a releasable pawl carried on the bail which is operable to engage any one of a plurality of notches formed on the control structure.

3. The control structure as recited in claim 2, wherein:

the pawl is carried adjacent the first control lever.

4. The control structure as recited in claim 3, further comprising:

a discharge chute mounted for swinging about an upstanding axis to a plurality of positions, an electric motor operably coupled to the chute to move it throughout its plurality of positions, and an electric switch carried on the bail and operably coupled to the motor to swing the chute between its plurality of positions.

5. The control structure as recited in claim 4, wherein:

the switch is coupled to the bail adjacent the second control lever.

* * * * *